US007926158B2

(12) United States Patent
Kozina et al.

(10) Patent No.: US 7,926,158 B2
(45) Date of Patent: Apr. 19, 2011

(54) SAW BLADE CHANGING TOOL

(75) Inventors: Damian A. Kozina, Chicago, IL (US); Edward D. Adkins, Loves Park, IL (US)

(73) Assignee: Nomis LLC, Hampshire, IL (US)

( * ) Notice: Subject to any disclaimer, the term of this patent is extended or adjusted under 35 U.S.C. 154(b) by 1016 days.

(21) Appl. No.: 11/745,103

(22) Filed: May 7, 2007

(65) Prior Publication Data

US 2008/0276450 A1 Nov. 13, 2008

(51) Int. Cl.
*B25B 33/00* (2006.01)

(52) U.S. Cl. ..... 29/271; 29/255; 29/281.1; 29/278; 29/281.6

(58) Field of Classification Search ..... 29/281.1, 29/283.5, 255, 281.6, 271, 278
See application file for complete search history.

(56) References Cited

U.S. PATENT DOCUMENTS 2,878,701 A * 3/1959 Weersma ..... 81/438
5,231,733 A * 8/1993 Dittman ..... 16/412
5,829,324 A * 11/1998 Secor ..... 81/53.11
5,983,480 A 11/1999 Fontaine et al.
7,028,999 B2 * 4/2006 Sunadome ..... 269/47
7,621,504 B2 * 11/2009 McCallum ..... 254/88
2007/0264094 A1 * 11/2007 Seeley ..... 408/224
2008/0276450 A1 * 11/2008 Kozina et al. ..... 29/700

* cited by examiner

*Primary Examiner* — Lee D Wilson
(74) *Attorney, Agent, or Firm* — Reinhart Boerner Van Deuren P.C.

(57) ABSTRACT

A blade changing tool for changing a blade for saws, particular table saws, is provided. The tool includes a body having a face that includes at least one recess for receiving and engaging a saw blade. Typically, the face will include a plurality of axially offset recesses resulting in a stepped face. A blade face abutment surface and a riser extending therefrom combine to form the recesses. The risers may be concave in shape giving the recesses a circular segment shape. The body also includes at least one blade engaging catch that engages teeth of the blade to prevent rotational movement of the blade while it is being loosened or tightened. The tool may be free of undercuts to facilitate straight-pull molding. Also, the stepped face may be an external face to facilitate visually inspecting the engagement between the blade and the tool.

24 Claims, 5 Drawing Sheets

SAW BLADE CHANGING TOOL

FIELD OF THE INVENTION

This invention generally relates to saws and more, particularly to tools for changing the circular blade of a saw.

BACKGROUND OF THE INVENTION

Saws are used for cutting stock material such as wood, plastic, metal and the like to a desired shape and/or size. After extensive use, the blade of the saw may become worn and need replacing. Alternatively, a saw operator may switch from working with one material to another or may desire to alter the cutting action of the saw, and therefore may be similarly required to change the blade or the orientation of the blade of the saw.

Typically, saws that use a circular saw blade use a nut to mount the blade on a shaft that is rotated by the saw to rotate the blade. Typically, the blade is secured to the shaft by a nut. When the blade needs to be replaced or otherwise removed, the nut must be loosened and removed from the shaft to release the blade. However, the shaft typically freely rotates within the saw when power is not provided to the saw. As such, application of torque to the nut to remove the nut from the shaft will cause the shaft and blade to rotate unless the blade and/or shaft is prevented from rotating.

In the past, the operator would use an additional tool to stop the blade from rotating while torque is applied to the nut. In many instances, the second tool was a block of wood. Many operators would unplug the saw and engage a block of wood with the teeth of the saw blade to prevent it from rotating. With the saw blade engaging the block of wood, the operator could use a wrench to apply torque to the nut and loosen it. However, as the blade was uncovered, if the wrench were to slip from the nut, the exposed teeth of the saw blade provided the potential for minor cuts or injuries to the operator. Further, to attain leverage for loosening the nut, the operator may position his free hand against the block of wood. As such, should the wood or wrench slip, the operator's other hand could also potentially contact the blade and become injured.

U.S. Pat. No. 5,983,480 to Fontaine et al. has attempted to prevent these problems by providing a blade changing tool that uses an arcuate guard that engages a blade that includes a slot having two sidewalls and a bottom. The tool also includes two feet that project from one sidewall to abut the table of the saw to prevent the blade from rotating. However, the present inventors identified what they believe to be several drawbacks of the '486 patent as will be further evident from the present disclosure including (1) the tool provides only a single size arcuate slot which is only closely sized for a single size blade; (2) the tool includes a complex design such that it includes undercuts, which prevent the device from being manufactured from a straight-pull mold thereby increasing manufacturing costs; (3) as the engagement between the teeth of the blade and the tool is hidden within the slot and behind the two parallel sides, it can be difficult to determine if the tool has properly been engaged with the tool.

There exists, therefore, a need in the art for an improved blade changing tool that facilitates removal of the blade, but makes it easier to determine if the tool is properly engaging the blade, can be manufactured more efficiently, and/or can easily accommodate multiple blade sizes.

BRIEF SUMMARY OF THE INVENTION

The invention provides an improved tool for assisting with changing the blade of a saw that can accommodate multiple blade sizes while being less complex to manufacture, and/or provides improved visibility for inspecting the engagement between a saw blade and the tool.

In some forms of the invention, the tool includes a body having a stepped face that provides a plurality of steps. The steps may be provided by recesses sized to receive different sized saw blades. The recesses may have a blade face abutment surface that is positioned proximate a face of the blade during use and a riser extending axially outward from the blade face abutment surface that is proximate the teeth of the blade during use. The tool further includes a tooth engaging catch for engaging the blade to control the blade and prevent its rotation during tightening or loosening of a nut holding the blade to the saw.

In some forms of the invention, the body of the tool is formed free of undercuts such that the body may be formed using a straight-pull mold that includes only two shells. In such a form, the body may be formed using injection molding and using plastic material.

In some forms of the invention, the body includes a handle for the operator to control the position and prevent movement of the tool during use. The handle may or may not be formed as one piece with the body.

The body may include feet that extend axially outward from a rear face of the body that is on the opposite side as the stepped face. The feet may be used to traverse any slot in the table of the saw and prevent the tool from rotating with the blade while loosening or tightening. Further, the feet can help stabilize the body while using the tool.

In some forms of the invention, the face that includes the blade receiving recesses, or even a single blade receiving recess, i.e. the stepped face, may be open such that the face is an external face. This configuration can simplify the tool as well as improve visual inspection of the engagement between the tool and the saw blade. In another forms of the invention, the stepped face may be hidden behind a plate or wall that extends downward in front of at least part of the recesses.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
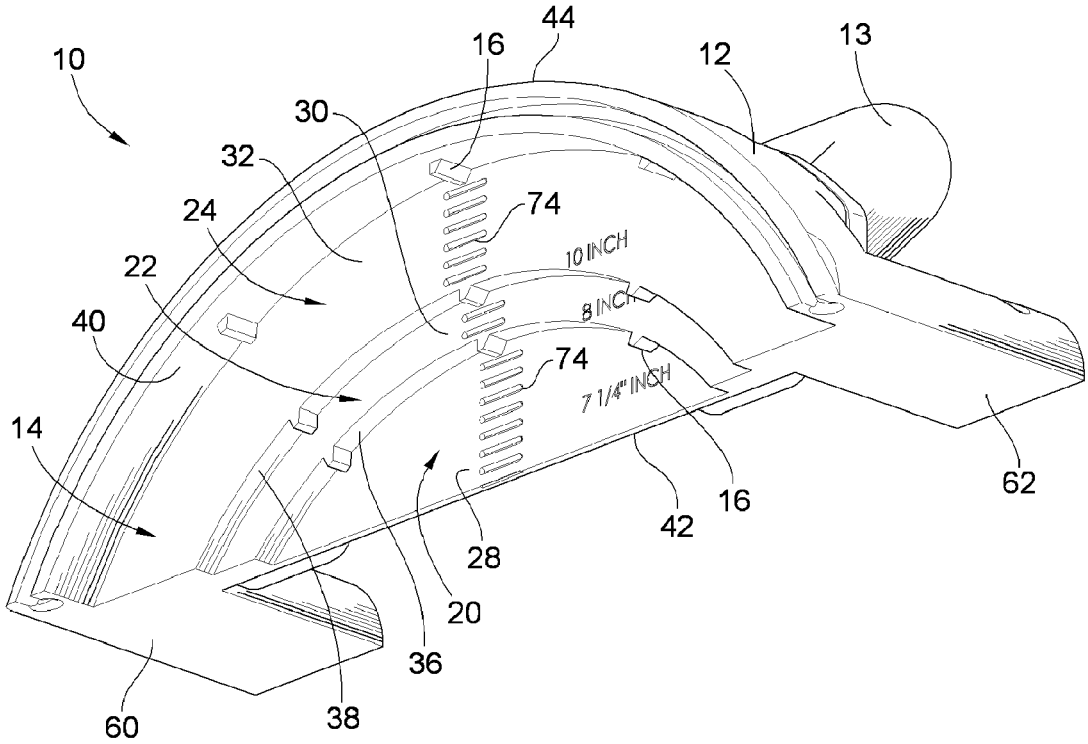
FIG. 1 is a perspective bottom view of an exemplary embodiment of a blade changing tool in accordance with the teachings of the present invention.
Figure 6:
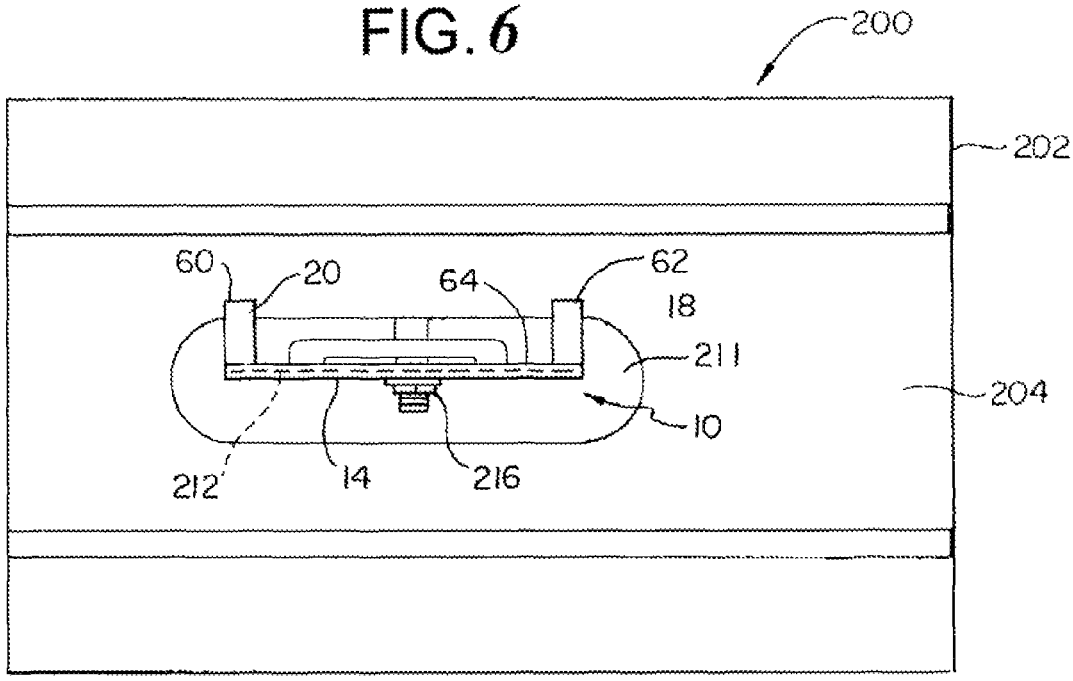
FIG. 6 is a top plan view of the blade changing tool positioned adjacent to the saw blade of FIG. 5.

FIG. 1 illustrates an exemplary embodiment of a blade changing tool 10 according to the teachings of the present invention for assisting changing the blade 212 of a circular saw especially a table saw 200 (see FIGS. 6 and 7). The illustrated blade changing tool 10 generally includes a body 12 and a handle 13. The body 12 generally includes a stepped face 14 and a plurality of blade engaging catches illustrated in the form of protrusions 16

The stepped face 14 of the illustrated embodiment defines or otherwise includes a plurality of steps illustrated in the form of arcuate recesses 20-24 that are recesses for receiving blades. The recesses 20-24 are generally concentric and axially offset from one another. A blade face abutment surface 28-32 cooperates with a corresponding riser 36-40 that extends axially outward from the blade face abutment surface 28-32 to form each recess 20-24, respectively. Due to the arcuate shape of the risers 36-40 of the illustrated embodiment, each recess 20-24 can be viewed as a minor segment of a circle bordered or defined by a riser 36-40 and the bottom edge of the body 12.

The blade face abutment surfaces 28-32 are axially offset from one another by the risers 36-40. In use, the blade face abutment surfaces 28-32 axially position the blade changing tool 10 relative to a saw blade 212. More particularly, one of the blade face abutment surfaces 28-32 is positioned axially proximate a face or side of the saw blade during the changing process.

Figure 2:
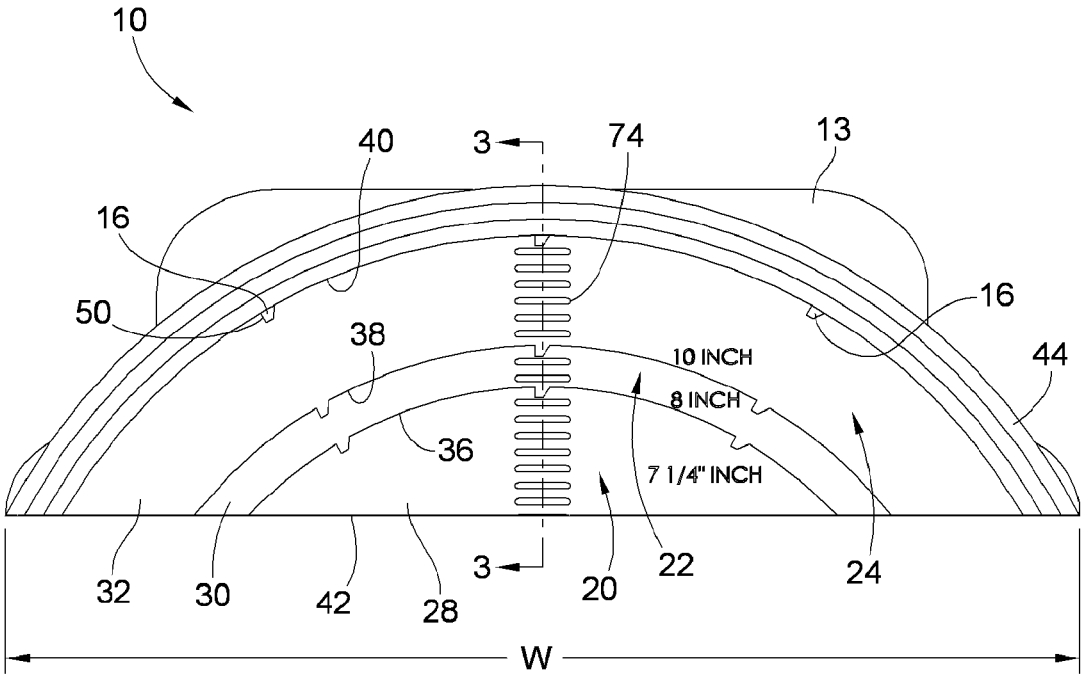
FIG. 2 is a front profile view of the blade changing tool of FIG. 1.
Figure 5:
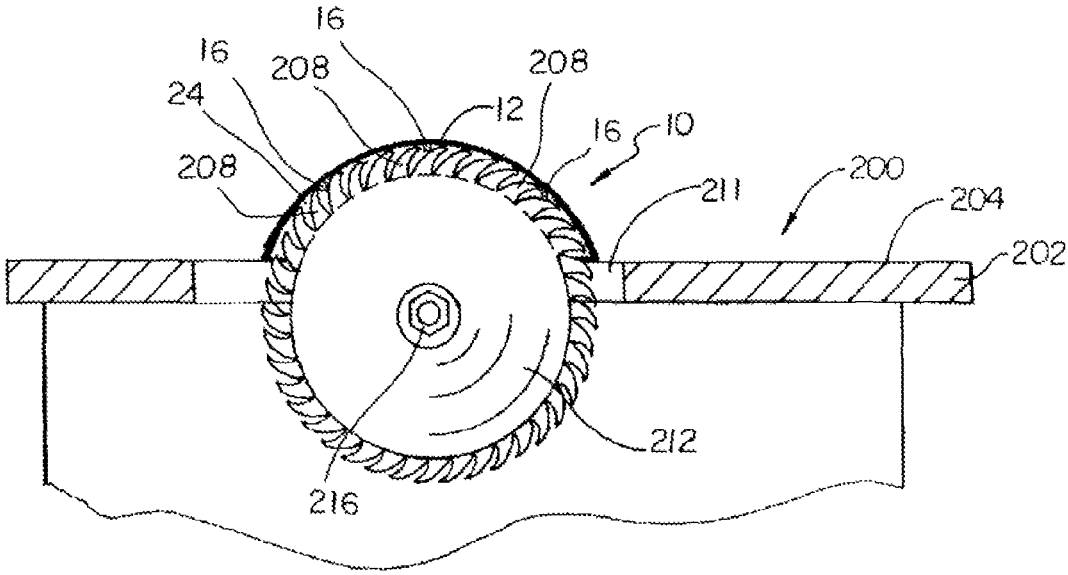
FIG. 5 is an elevation view of the blade changing tool of FIG. 1 positioned adjacent to a saw and a saw blade such as during operation.

Each riser 36-40 extends axially outward from a corresponding blade face abutment surface 28-32 to define the radially outer periphery of each recess 20-24, respectively. In use, the blade changing tool 10 is generally radially positioned relative to the edge of the saw blade 212 defined by the teeth 208 of the saw blade 212 such that one of the risers 36-40 is positioned radially against or proximate the teeth 208 of the saw blade 212. As illustrated in FIGS. 5 and 6, riser 40, the radially outermost riser, is illustrated as bordering a the exposed teeth 208 of the saw blade 212. As such, an operator is protected from the teeth 208 by the blade changing tool 10. With reference to FIGS. 1 and 2, the risers 36-40 are illustrated as concave surfaces opening towards the bottom edge 42 of the body 12. During blade changing operations, the saw blade 212 will be raised relative to the top 204 of the table 202 to the same height as the inner surface of the corresponding riser 36-40.

The risers 36-40 are generally concentric minor arcs having differing radii. As the risers 36-40 are concentric and the recesses 20-24 are centered about the width W of the body 12, the midpoint of each riser 36-40 aligns at the center of the width W of the body 12. The bottom edge 42 of the body 12 forms the cord that defines the ends of the individual risers 36-40.

The concave shape of each riser 36-40 is closely sized to the respective blade size that the individual recess 20-24 is designed to receive. Preferably, the blade changing tool 10 includes at least three recesses configured to receive standard sized saw blades having diametrical sizes of seven and one-quarter inch (7¼"), eight inch (8") and ten inch (10"), respectively. However, saw blade changing tools 10 according to the teachings of the present invention can be sized for other saw blade sizes.

Risers 36, 38 between recesses 20 and 22 and recesses 22 and 24, respectively, offset the adjacent recesses 20, 22 and 22, 24 from one another. These offsets provide the stepped configuration of the face 14. Further, lending to the stepped configuration is riser 40 positioned between abutment face 32 of recess 24 and an outer rim 44 of the body 12.

The protrusions 16 are used to engage individual teeth 208 of the saw blade 212 to prevent the saw blade 212 from rotating while torque is operatively applied to the nut 216 securing the saw blade 212 while releasing or tightening. The illustrated protrusions 16 are positioned proximate to and are unitarily formed with the risers 36-40. A protrusion 16 may extend the same distance outward from the blade abutment surface as the riser of its respective recess such as the protrusions 16 proximate risers 36 and 38. Alternatively, a protrusion may extend axially outward a shorter distance than the riser of its respective recess such as illustrated with protrusion 16 of recess 24 proximate riser 40.

The protrusions 16 are one form of an engaging catch for engaging the teeth 708 of a saw blade 212 that can be incorporated when practicing the present invention. As illustrated in FIG. 2, the protrusions include a tooth engaging face 50 that engages a tooth 208. The tooth engaging face 50, as illustrated, extends radially inward from its respective riser 36-40. It is preferred that the tooth engaging face 50 forms an angle with a riser 36-40 that is equal to or less than 90 degrees to prevent the tooth 208 from slipping relative to the protrusion 16. While the protrusions 16 are all illustrated as having the tooth engaging face 50 on the same side, other blade changing tools can have symmetric protrusions where both sides of the protrusions are configured to engage the cutting edge of a tooth.

Figure 3:
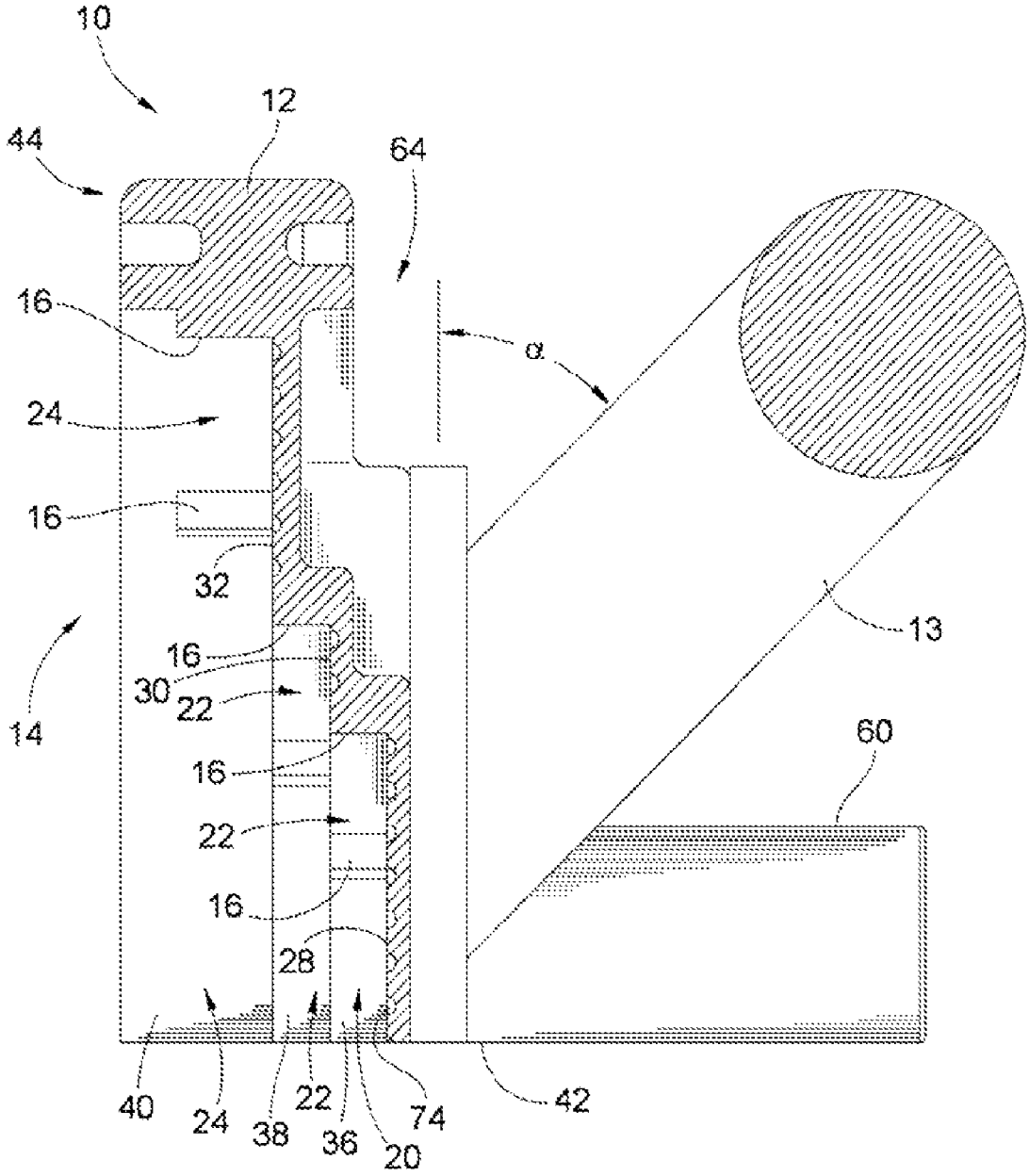
FIG. 3 is a cross-sectional view of the blade changing tool of FIG. 1 about line 3-3 of FIG. 2.
Figure 4:
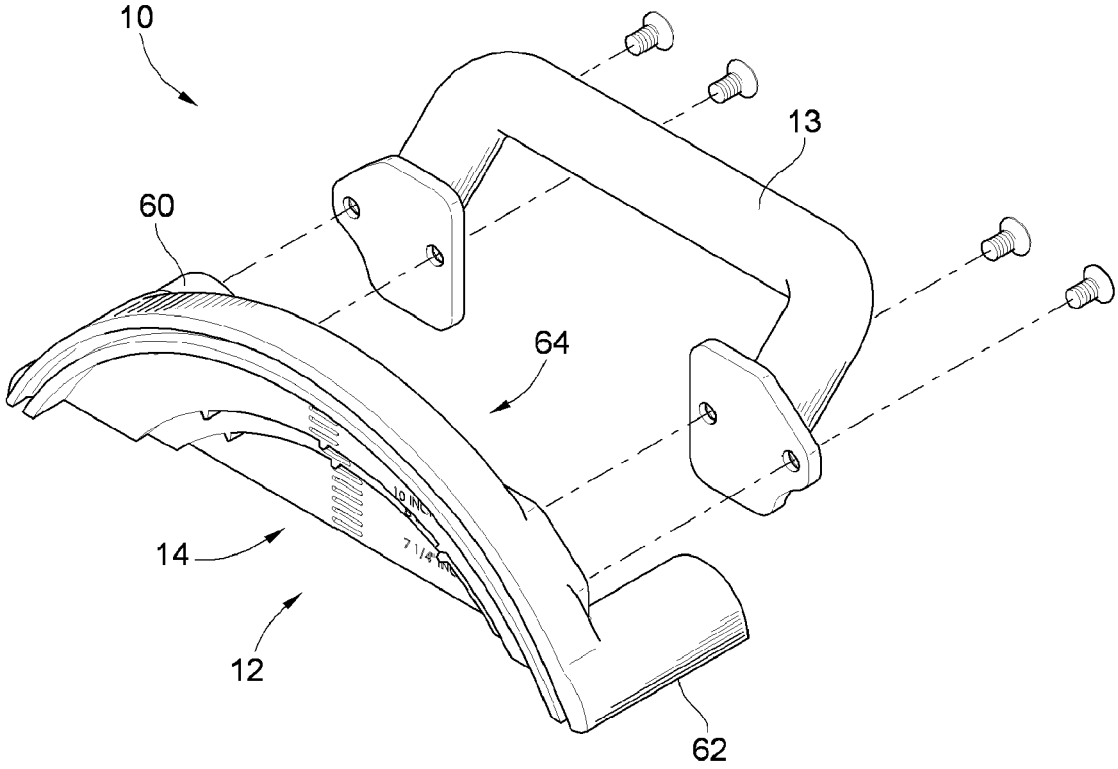
FIG. 4 is an exploded top perspective view of the blade changing tool of FIG. 1.

It can be appreciated from FIGS. 1 through 3 that the stepped face 14 of the body 12 is an open face that is fully exposed. In other words, the recesses 20-24 and protrusions 16 are not positioned between the body 12 and a separate wall or plate. This configuration facilitates improved visibility for determining the engagement between the teeth 208 of the blade 212 and the blade changing tool 10.

However, in alternative embodiments, the blade changing tool could include a separate wall or plate (not shown) attached or integrally formed to the rim 44 of the body 12. In such a configuration, the wall or plate would cover the entire stepped face 14 or only a portion of the stepped face 14. In this configuration, the stepped face 14 would be an internal or inner face internal to the cavity formed between the body 12 and the additional plate or wall. The saw blades 212 would be received between the body 12 and the plate or wall at least partially in a radial direction. Such a wall or plate could provide additional safety for the operator.

The body 12 also includes two feet 60, 62 extending axially outward from a rear face 64 of the body. With reference to FIG. 1, the feet 60, 62 align with the bottom edge 42 of the body 12 and have a generally flat or planar bottom surface. With reference to FIG. 7, the feet 60,62 function to abut against the top 204 of the table 202 of the table saw 200 as the saw blade 212 is being torqued during tightening or loosening of the saw blade 212. More particularly, as the table 202 includes a slot 211 through which the saw blade 212 extends, the feet 60, 62 function to extend across the slot 211. Depending on the direction of rotation, one of the feet 60,62 will be biased into the top 204 of the table 202 to stop rotation of the saw blade 212 as the nut 216 is being torqued.

With reference to FIG. 1, it can be seen that the primary features of body 12 of the blade changing tool 10 are formed such that the body 12 is generally free of undercuts. An undercut would occur when it is impossible to form a two shell or two piece mold to define all of the structures of the body 12. As the body 12 is free of undercuts, the body 12 can be generally formed by a straight-pull mold using an injection molding process. More particularly, the body 12 can be formed using only two mold shells. The mold shells move relative to one another along a mold pull axis. In the illustrated embodiment, the mold pull axis is generally horizontal or parallel to the extension of the protrusions 16 from the blade face abutment surfaces 28-32 and generally perpendicular to the blade face abutment surfaces 28-32. Typically, the body 12 will be injection molded from a plastic material to form a one-piece body.

The handle 13 preferably extends at an angle $\alpha$ relative to body 12. The handle 13 permits the operator to control the blade changing tool 10 while tightening or loosening the saw blade 212. The angled orientation permits the operator to easily apply radial and axial loading to the blade changing tool 10. By being able to apply loads in both directions, the operator can more securely engage the saw blade 212 with the blade changing tool 10. Further, the feet 60, 62 prevent the blade changing tool 10 from tipping away from the saw blade 212 so that the blade changing tool 10 does not disengage the saw blade 212.

The angled handle configuration may generate undercuts if the handle 13 was formed as one piece with body 12 preventing a straight-pull mold from being employed to injection mold the body 12. As such, the handle 13 is formed as a second piece that is attached to the rear face 64 of the body 12 rather than having the body 12 and handle 13 formed as one-piece. However, other embodiments could form the handle 13 and body 12 as a one-piece body. Further, the handle 13 could only extend axially or radially to more easily facilitate straight-pull molding.

Depending on the cutting operation to occur after a saw blade 212 has been mounted to the saw 200, the operator may desire to adjust the height at which the blade extends above the top 204 of the table 202 of the saw 200. As such, the blade changing tool 10 may include blade height indicators 74 so that the operator can quickly, and without the assistance of other tools, adjust the blade height to a desired working level. The blade height indicators 74 are indentations formed in the blade face abutment surfaces 28-32 of the individual recesses 20-24. The blade height indicators 74 are preferably spaced apart at equal increments. As illustrated, the blade height indicators 74 are centered along the width W of the body 12.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A saw blade changing tool comprising:

a body having a stepped face including a plurality of steps; and at least one engaging catch extending outward from a plurality of the steps;

a riser between each pair of adjacent steps; the riser being generally concave and offsetting the steps along an offset axis; and wherein the engaging catches extend generally radially inward from a corresponding riser.

2. The saw blade changing tool of claim 1, wherein the plurality of steps are axially offset, recesses formed by corresponding risers and blade face abutment surfaces; each riser extending axially outward from a corresponding blade face abutment surface.

3. The saw blade changing tool of claim 1, wherein the riser between each pair of adjacent steps is arcuate.

4. The saw blade changing tool of claim 3, wherein the risers are generally concentric.

5. A saw blade changing tool comprising;

a body having a stepped face including a plurality of steps;

at least one engaging catch extending outward from a plurality of the steps, further including an arcuate riser between each pair of adjacent steps; the riser being generally concave and offsetting the steps; and wherein the engaging catches extend generally radially inward from a corresponding riser.

6. The saw blade changing tool of claim 1, further including a handle positioned on an opposite face of the body as the stepped face.

7. The saw blade changing tool of claim 1, wherein the body is free of undercuts relative to a generally horizontal axis.

8. The saw blade changing tool of claim 7, wherein the body, steps, and engaging catches are formed from plastic in a one-piece body.

9. The saw blade changing tool of claim 1, further including a pair of feet extending axially outward from a face of the body that is opposite the stepped face, a bottom surface of the feet aligning with a bottom edge of the body.

10. The saw blade changing tool of claim 2, wherein the plurality of recesses are generally shaped as a minor segment of a circle and are concentric.

11. The saw blade changing tool of claim 1, further including a plurality of blade height indicators being spaced apart indentations in the steps.

12. The saw blade changing tool of claim 1, wherein the stepped face is exposed in an axial direction extending parallel to the offset axis.

13. A saw blade changing tool comprising:

a body having a face having a blade receiving recess formed between a blade face abutment surface and a concave riser extending outward from the blade face abutment surface along an offset axis;

at least one engaging catch extending outward from the blade abutment surface and generally radially inward from the riser; and wherein the body is free of undercuts relative to a mold pull axis such that the body may be formed using a straight-pull mold.

14. The saw blade changing tool of claim 13, wherein the body and engaging catch are formed as one-piece.

15. The saw blade changing tool of claim 13, wherein the face is an open face.

16. The saw blade changing tool of claim 13, wherein the body includes a plurality of blade receiving recesses; the recesses being axially offset from one another.

17. A saw blade changing tool comprising:

a body having an open front face that includes a plurality of blade receiving recesses, each recess being axially offset from the other blade receiving recesses in a stepped manner along an offset axis, each recess having a generally arcuate radially outer periphery and being formed by a generally planar abutment surface and a concave riser surface extending outward from the abutment surface, adjacent pairs of receiving recesses being offset by a concave riser surface and the concave riser surfaces forming arcuate radially outer peripheries, each receiving recess having a different radial size than the other receiving recesses; and at least one saw blade tooth engaging protrusion for each blade receiving recess, each engaging protrusion extending axially outward relative to a corresponding abutment surface and extending radially inward from the riser surface of its respective receiving recess.

18. The saw blade changing tool of claim 17, wherein the body is free of undercuts in a direction extending substantially perpendicular to the blade abutment surfaces.

19. The saw blade changing tool of claim 18, further comprising a handle attached to a back face of the body and the body further comprising a pair of feet extending axially outward from the back face.

20. A saw blade changing tool comprising:

a body having an open front face that includes a plurality of blade receiving recesses, each recess being axially offset from the other blade receiving recesses in a stepped manner, each recess having a generally arcuate radially outer periphery and being formed by a generally planar abutment surface and a concave riser surface extending outward from the abutment surface, adjacent pairs of receiving recesses being offset by an concave riser surface and the concave riser surfaces forming arcuate radially outer peripheries, each receiving recess having a different radial size than the other receiving recesses; and at least one saw blade tooth engaging shoulder for each blade receiving recess, each engaging shoulder extending axially outward relative to a corresponding abutment surface and extending radially inward from the riser surface of its respective receiving recess; and including at least three blade receiving recesses, a first recess being sized to receive a seven and one-quarter inch diameter blade, a second recess being sized to receive an eight inch diameter blade, and a third recess being sized to receive a ten inch diameter blade; the second recess being axially interposed between the first and third recesses.

21. The saw blade changing tool of claim 1, wherein the body is accessible by a circular saw blade in a direction extending substantially perpendicular to the offset axis for engagement by the circular saw blade with the engaging catches.

22. The saw blade changing tool of claim 13, wherein the saw blade receiving recess is accessible by a circular saw blade in a direction extending substantially perpendicular to the offset axis for engagement by the circular saw blade with the at least one engaging catch.

23. The saw blade changing tool of claim 17, wherein the saw blade receiving recesses are accessible by a circular saw blade in a direction extending substantially perpendicular to the offset axis for engagement by the circular saw blade with the saw blade tooth engaging protrusion.

24. The saw blade changing tool of claim 1, wherein the body is mountable onto a circular saw blade with the axis of rotation of the circular saw blade substantially parallel with offset axis and the circular saw blade, extends out of the body in a direction extending substantially perpendicular to the offset.

* * * * *